US010829961B2

(12) United States Patent
Lauyans

(10) Patent No.: US 10,829,961 B2
(45) Date of Patent: Nov. 10, 2020

(54) SECURITY ANCHOR

(71) Applicant: Frank M. Lauyans, Louisville, KY (US)

(72) Inventor: Frank M. Lauyans, Louisville, KY (US)

( * ) Notice: Subject to any disclaimer, the term of this patent is extended or adjusted under 35 U.S.C. 154(b) by 129 days.

(21) Appl. No.: 16/261,644

(22) Filed: Jan. 30, 2019

(65) Prior Publication Data

US 2019/0242158 A1 Aug. 8, 2019

Related U.S. Application Data

(60) Provisional application No. 62/625,442, filed on Feb. 2, 2018.

(51) Int. Cl.
*E05B 67/38* (2006.01)
*E05B 73/00* (2006.01)

(52) U.S. Cl.
CPC ..... *E05B 67/383* (2013.01); *E05B 73/0005* (2013.01)

(58) Field of Classification Search
CPC ..... E05B 67/383; E05B 73/0005
USPC .. 70/2, 18, 58, 225–228, 232–236, DIG. 30, 70/DIG. 57; 292/281; 109/50–52; 52/155, 157, 698, 713; 182/45; 248/499, 248/551–553
See application file for complete search history.

(56) References Cited

U.S. PATENT DOCUMENTS 3,081,056 A * 3/1963 Sweet ..... B25H 3/04 248/552
3,312,794 A * 4/1967 Hollyday ..... H01H 9/282 200/43.15
3,879,721 A * 4/1975 Yereance ..... E05B 45/02 70/441
4,170,334 A * 10/1979 Villanueva ..... E05B 73/00 211/4
4,260,861 A * 4/1981 DiMarco ..... H01H 9/282 200/43.15
5,257,839 A * 11/1993 Nielsen ..... E05C 19/14 292/104
5,349,834 A * 9/1994 Davidge ..... E05B 15/1607 156/306.6
5,361,611 A * 11/1994 Hisler ..... A01K 97/00 211/4

(Continued)

OTHER PUBLICATIONS

Canadian Intellectual Property Office, Examiner's Report issued in corresponding Application No. 3,032,161, dated Jan. 13, 2020.

*Primary Examiner* — Lloyd A Gall
(74) *Attorney, Agent, or Firm* — Stites & Harbison, PLLC; David W. Nagle, Jr.

(57) ABSTRACT

A security anchor comprises a first (or base) plate and a second (or clamping) plate that is adapted to fit over and engage the first plate. In use, fasteners pass through one or more holes defined through a central portion of the first plate to secure the first plate to a fixed object, such as a wall or floor. The second plate fit overs and engages the first plate, with a tab of the second plate received in a slot defined by a first upstanding wall portion of the first plate One or more holes defined in an upstanding wall portion of the second plate are in registry with one or more holes defined through a second upstanding wall portion of the first plate, such that a locking device can be passed through a selected pair of registered holes and connected to an item that is to be secured.

19 Claims, 5 Drawing Sheets

(56) References Cited

U.S. PATENT DOCUMENTS

| | | | | | |
|---|---|---|---|---|---|
| 5,456,443 | A | | 10/1995 | Taaffe | |
| 5,562,177 | A | * | 10/1996 | Chacon | B60R 25/00 180/287 |
| 5,755,125 | A | * | 5/1998 | Charrette | B60R 25/09 410/19 |
| 6,015,956 | A | * | 1/2000 | Green | H01H 9/283 200/43.14 |
| 6,053,016 | A | * | 4/2000 | Young | E05B 73/0082 70/159 |
| 6,142,313 | A | * | 11/2000 | Young | F41A 17/02 211/4 |
| 6,896,223 | B2 | * | 5/2005 | Fulcher | B64F 1/16 188/32 |
| 7,204,105 | B2 | * | 4/2007 | Hooper | E05B 17/142 200/43.14 |
| 2012/0103031 | A1 | * | 5/2012 | Grant | E05B 73/0005 70/14 |

* cited by examiner

SECURITY ANCHOR

CROSS-REFERENCE TO RELATED APPLICATIONS

The present application claims priority to U.S. Patent Application Ser. No. 62/625,442 filed on Feb. 2, 2018, the entire disclosure of which is incorporated herein by reference.

BACKGROUND OF THE INVENTION

Various padlocks, chains, cables, and/or similar devices have been developed and are used to secure items of value. For example, in a garage, storage facility, or similar environment, padlocks, chains, cables, and/or similar devices may be used to connect a vehicle, motorcycle, bicycle, lawn and garden equipment, or other items to a fixed object, such as a wall or floor, via some form of anchor. However, in such arrangements, the anchor can be vulnerable. In other words, by removing or dislodging the anchor from the fixed object (i.e., the wall or floor), the security precaution can be defeated.

Thus, there remains a need for a security anchor that addresses certain deficiencies in prior art constructions.

SUMMARY OF THE INVENTION

An exemplary security anchor made in accordance with the present invention generally comprises: a first (or base) plate; and a second (or clamping) plate that is adapted to fit over and engage the first plate.

In some embodiments, the first (or base) plate is a unitary body, but can be characterized as including: a central portion with a substantially rectangular shape; a first upstanding wall portion; and a second upstanding wall portion. The central portion of the first plate defines one or more holes therethrough. Thus, in use, fasteners pass through one or more of these holes to secure the first plate to a fixed object, such as a wall or floor. Furthermore, the first upstanding wall portion defines a slot therethrough, and the second upstanding wall portion defines one or more holes therethrough.

In some embodiments, the second (or clamping) plate is also a unitary body, but can be characterized as including: a central portion with a substantially rectangular shape; a tab extending from one edge of the central portion; an upstanding wall portion along an opposite edge of the central portion; a first leg that extends downwardly from a side edge of the central portion along substantially the length of central portion; and a second leg that extends downwardly from an opposite side edge of the central portion along substantially the length of central portion and substantially parallel to the first leg. Furthermore, the upstanding wall portion also defines one or more holes therethrough.

As mentioned above, in use, fasteners pass through one or more of the holes defined through the central portion of the first plate to secure the first plate to a fixed object, such as a wall or floor. Once the first plate has been secured to the fixed object, the second plate is placed over and into engagement with the first plate. Specifically, the tab extending from one edge of the central portion of the second plate is advanced into and received in the slot defined by the first upstanding wall portion of the first plate. The second plate is then effectively rotated into position, such that the upstanding wall portion of the second plate is positioned adjacent to the second upstanding wall portion of the first plate. In this position, the one or more holes defined through the upstanding wall portion of the second plate are in registry with the one or more holes defined through the second upstanding wall portion of the first plate.

Once the security anchor has been assembled with the second plate placed over and into engagement with the first plate, a padlock, chain, cable, or similar locking device is then passed through a selected pair of registered holes. That padlock, chain, cable, or similar locking device is then connected to an item that is to be secured. The fasteners that secure the security anchor to the fixed object are not accessible, as they are behind the central portion of the second plate. Furthermore, the first leg and the second leg that extend downwardly from the central portion of the second plate prevent any access to the fasteners from the side. Thus, the security anchor of the present invention cannot be readily removed or dislodged from the fixed object.

DETAILED DESCRIPTION OF THE INVENTION

The present invention is a security anchor.

Figure 1:
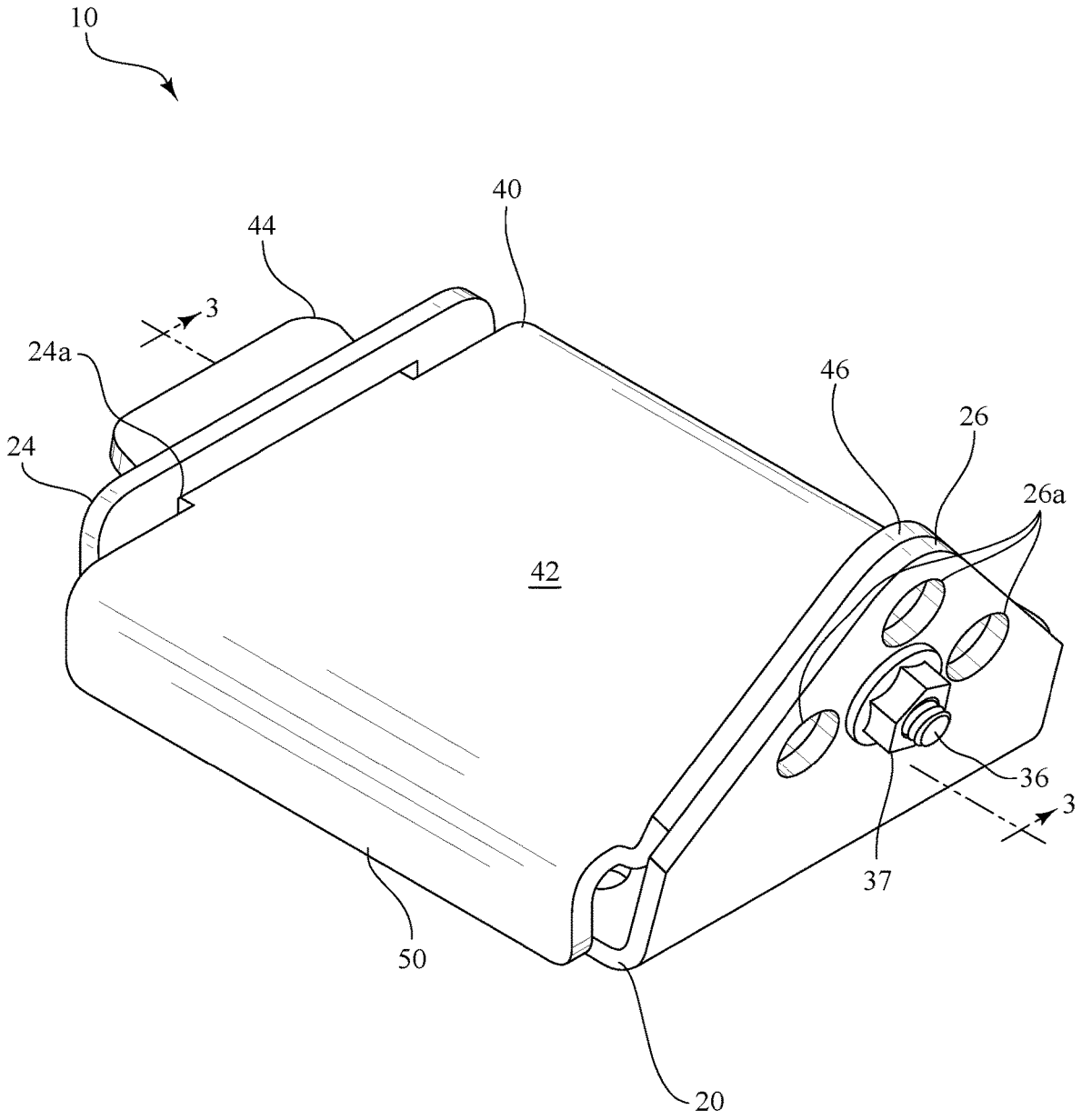
FIG. 1 is a perspective view of an exemplary security anchor made in accordance with the present invention.
Figure 2:
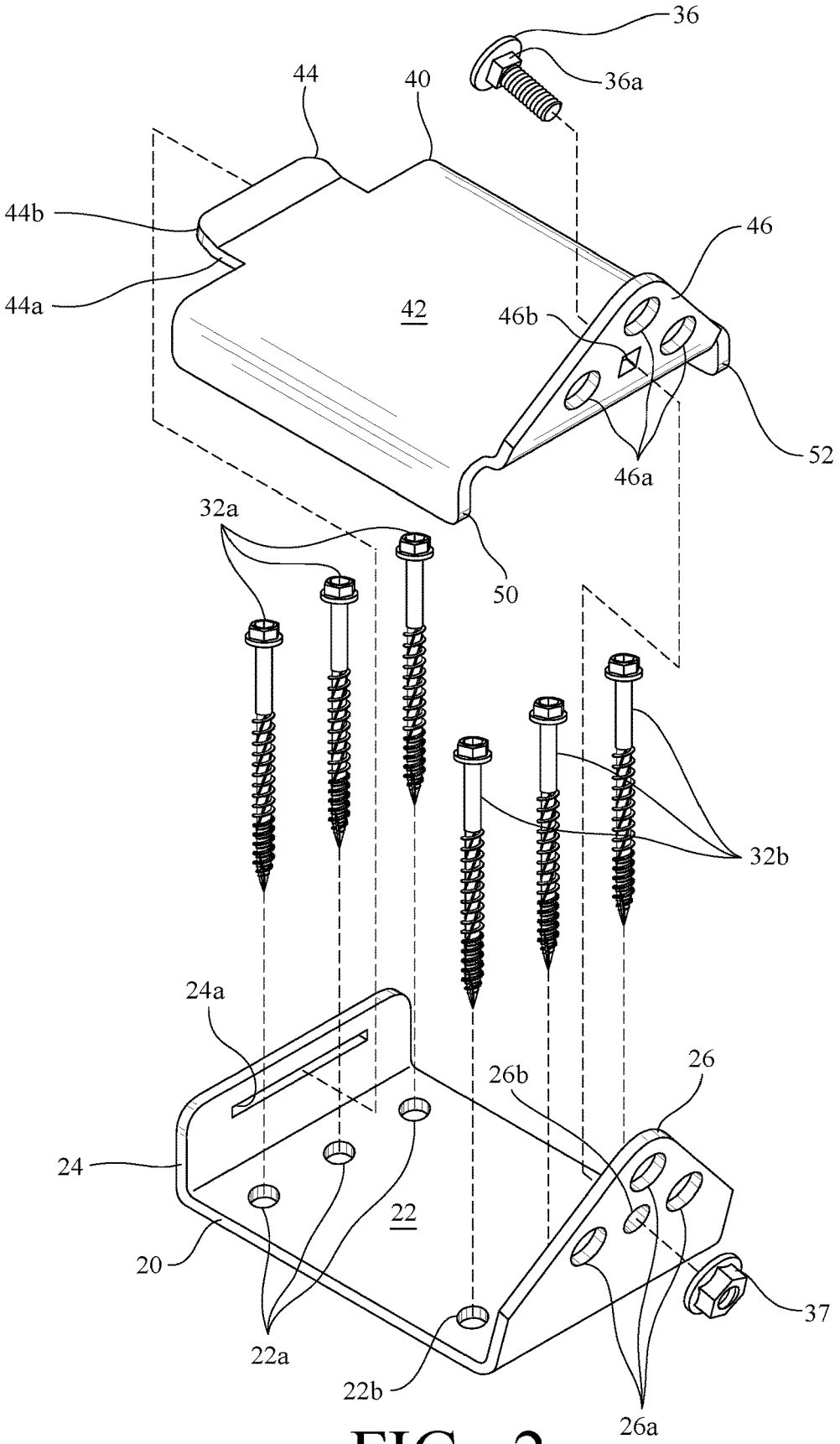
FIG. 2 is an exploded perspective view of the exemplary security anchor of FIG. 1.
Figure 3:
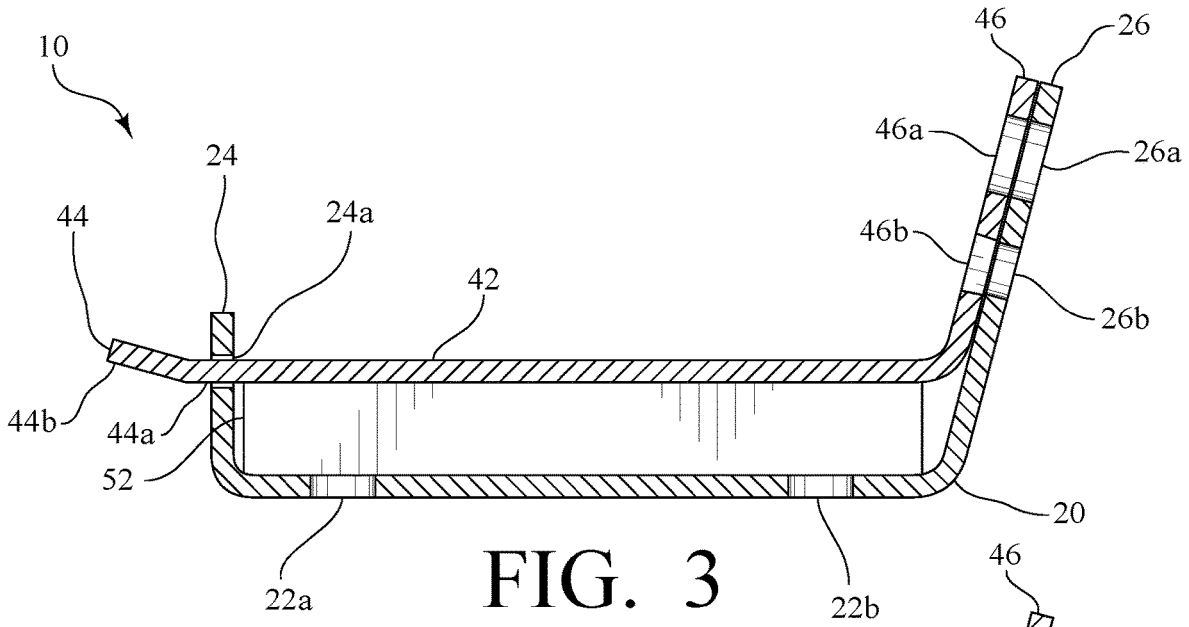
FIG. 3 is a side-sectional view of the exemplary security anchor of FIG. 1 taken along line 3-3 of FIG. 1.

Referring now to FIGS. 1-3, an exemplary security anchor 10 made in accordance with the present invention generally comprises: a first (or base) plate 20; and a second (or clamping) plate 40 that is adapted to fit over and engage the first plate 20.

Figure 5:
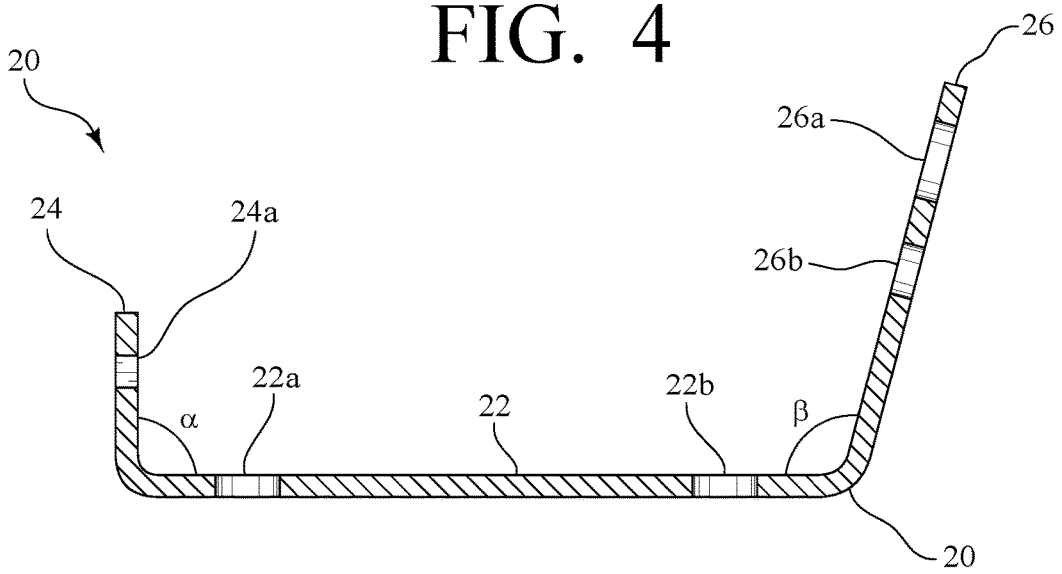
FIG. 5 is a side-sectional view similar to FIG. 3, but of the second (or clamping) plate in isolation.

In this exemplary embodiment, and as best shown in FIG. 2, the first (or base) plate 20 is a unitary body, but can be characterized as including: a central portion 22 with a substantially rectangular shape; a first upstanding wall portion 24; and a second upstanding wall portion 26. As shown, the first upstanding wall portion 24 is along one edge of the central portion 22, and the second upstanding wall portion 26 is along an opposite edge of the central portion 22. Furthermore, in this exemplary embodiment, and as best shown in the side-sectional view of FIG. 5, the first upstanding wall portion 24 is oriented at an angle, $\alpha$, of approximately 90° relative to the central portion 22, whereas the second upstanding wall portion 26 is oriented at an angle, $\beta$, of approximately 105° relative to the central portion 22, the importance of which will be discussed below.

Referring again to FIG. 2, the central portion 22 of the first plate 20 defines one or more holes therethrough. Specifically, in this exemplary embodiment, there are three holes 22*a* along one edge of the central portion 22, and three holes 22*b* (one of which is visible in FIG. 2) along an opposite edge of the central portion 22. Each of these holes 22*a*, 22*b* is adapted to accommodate a fastener 32*a*, 32*b*. Thus, in use, the fasteners 32*a*, 32*b* pass through one or more of these holes 22*a*, 22*b* to secure the first plate 20 to a fixed object, such as a wall or floor, as further discussed below. In FIG. 2, the fasteners 32*a*, 32*b* are illustrated as screws with both spiral flutes and serrated threads, which are suitable for insertion into multiple types of materials, including wood, masonry, and metal. Of course, various other forms of fasteners could also be used to secure the first plate 20 to a fixed object without departing from the spirit and scope of the present invention. Furthermore, although a fastener 32*a*, 32*b* is illustrated for each hole 22*a*, 22*b* in FIG. 2 (and FIG. 6), in most cases, it would not be necessary to use six fasteners 32*a*, 32*b*, but rather, a smaller number of fasteners 32*a*, 32*b* could be used to secure the first plate 20 to a fixed object.

Referring still to FIG. 2, the first upstanding wall portion 24 defines a slot 24*a* therethrough, and the second upstanding wall portion 26 defines one or more holes 26*a* therethrough, the importance of which will also be discussed below. Furthermore, in this exemplary embodiment, there is also another hole 26*b* defined through the second upstanding wall portion 26, the importance of which will also be discussed below.

Figure 4:
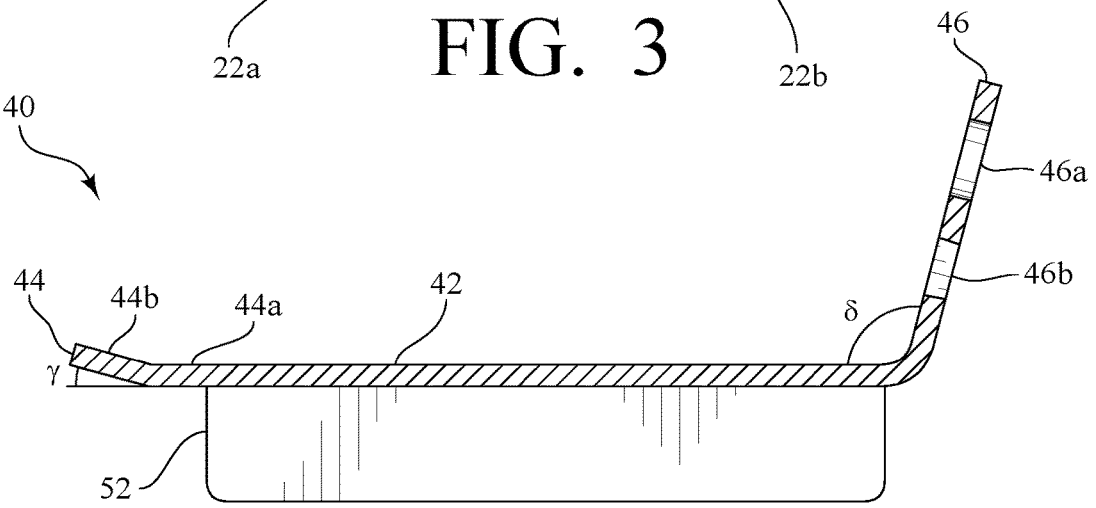
FIG. 4 is a side-sectional view similar to FIG. 3, but of the first (or base) plate in isolation.

Referring still to FIG. 2, in this exemplary embodiment, the second (or clamping) plate 40 is also a unitary body, but can be characterized as including: a central portion 42 with a substantially rectangular shape; a tab 44 extending from one edge of the central portion 42; an upstanding wall portion 46 along an opposite edge of the central portion 42; a first leg 50 that extends downwardly from a side edge of the central portion 42 along substantially the length of central portion 42; and a second leg 52 that extends downwardly from an opposite side edge of the central portion 42 along substantially the length of central portion 42 and substantially parallel to the first leg 50. Furthermore, in this exemplary embodiment, and as best shown in the side-sectional view of FIG. 4, the tab 44 is actually comprised of a first segment 44*a* that is in the same plane as the central portion 42 and a second segment 44*b* that extends upward at an angle, $\gamma$, of approximately 15° relative to the first segment 44*a* of the tab 44. Additionally, the upstanding wall portion 46 is oriented at an angle, $\delta$, of approximately 105° relative to central portion 42, while the first and second legs 50, 52 are oriented (downward) at approximately 90° relative to the central portion 42, the importance of which will be discussed below.

Referring again to FIG. 2, the upstanding wall portion 46 also defines one or more holes 46*a* therethrough, the importance of which will be discussed below. Furthermore, in this exemplary embodiment, there is also another hole 46*b* (which has a substantially square shape) defined through the upstanding wall portion 46, the importance of which will also be discussed below.

Figure 6:
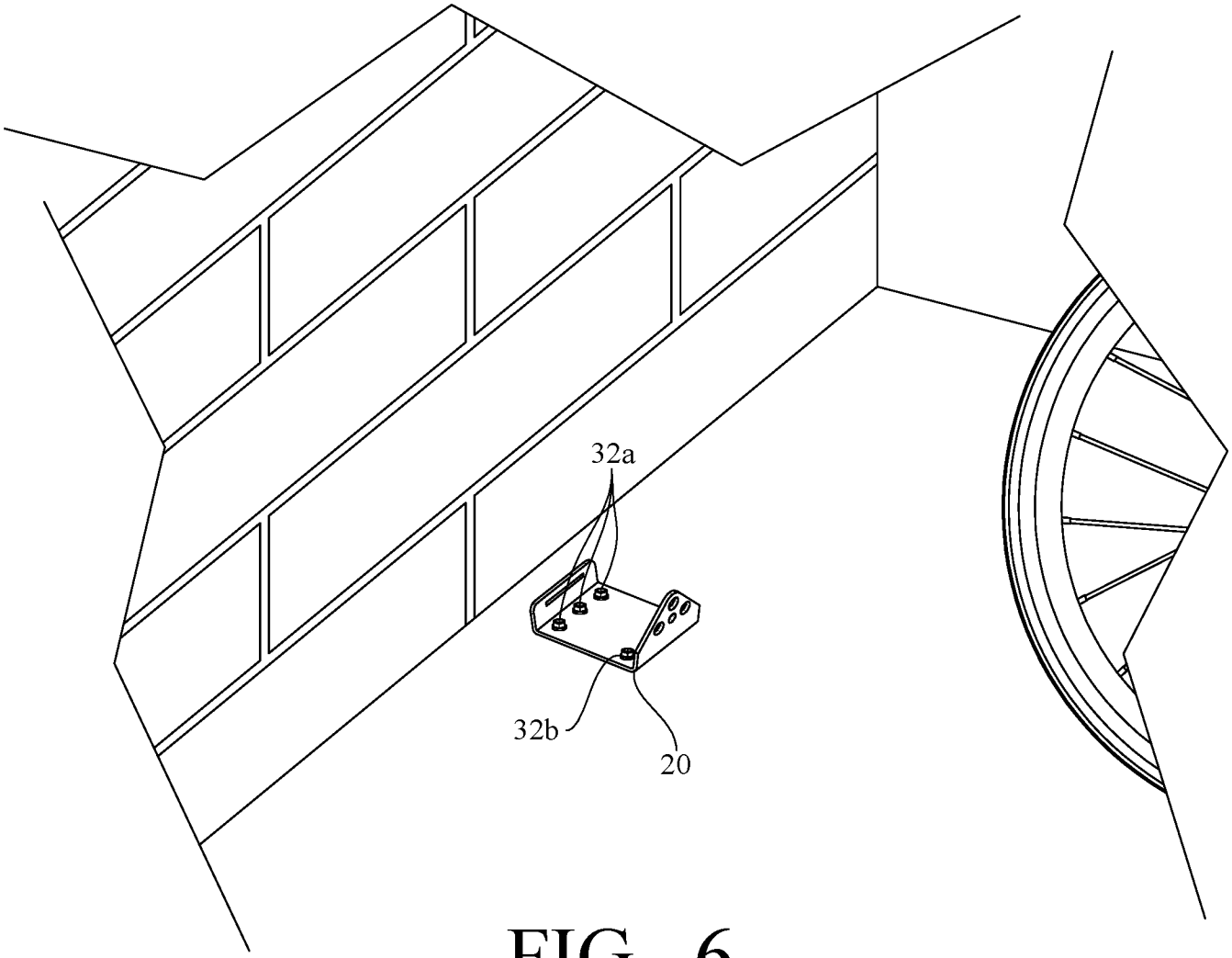
FIG. 6 illustrates the first (or base) plate of the exemplary security anchor of FIG. 1 secured to a floor by fasteners in one exemplary implementation.

Referring again to FIG. 1, along with the side-sectional view of FIG. 3, in use, the fasteners 32*a*, 32*b* pass through one or more of the holes 22*a*, 22*b* defined through the central portion 22 of the first plate 20 to secure the first plate 20 to a fixed object, such as a wall or floor. FIG. 3 does not show the fasteners 32*a*, 32*b*, but FIG. 6 illustrates the first plate 20 secured to a floor by fasteners 32*a*, 32*b* in one exemplary implementation.

Referring again to FIG. 1, along with the side-sectional view of FIG. 3, once the first plate 20 has been secured to the fixed object, the second plate 40 is placed over and into engagement with the first plate 20. Specifically, the tab 44 extending from one edge of the central portion 42 of the second plate 40 is advanced into and received in the slot 24*a* defined by the first upstanding wall portion 24 of the first plate 20. The second plate 40 is then effectively rotated into position, such that the upstanding wall portion 46 of the second plate 40 is positioned adjacent to the second upstanding wall portion 26 of the first plate 20. In this position, the one or more holes 46*a* defined through the upstanding wall portion 46 of the second plate 40 are in registry with the one or more holes 26*a* defined through the second upstanding wall portion 26 of the first plate 20.

As shown in FIGS. 1 and 3, in some embodiments, a carriage bolt 36 is passed through the holes 46*b*, 26*b*, which are in registry with one another, and then through a nut 37 to secure the second plate 40 to the first plate 20. In this exemplary embodiment, and as mentioned above, the hole 46*b* actually has a substantially square shape, which corresponds to a similarly shaped square portion 36*a* of the carriage bolt 36 positioned below the head of the bolt 36. Thus, in this exemplary embodiment, the square portion 36*a* of the carriage bolt 36 is seated in the hole 46*b*, such that the bolt 36 does not rotate when the nut 37 is screwed onto or off of the bolt 36. At the same time, however, although convenient, such a carriage bolt 36 and nut 37 combination is not required during use, as further discussed below.

Figure 7:
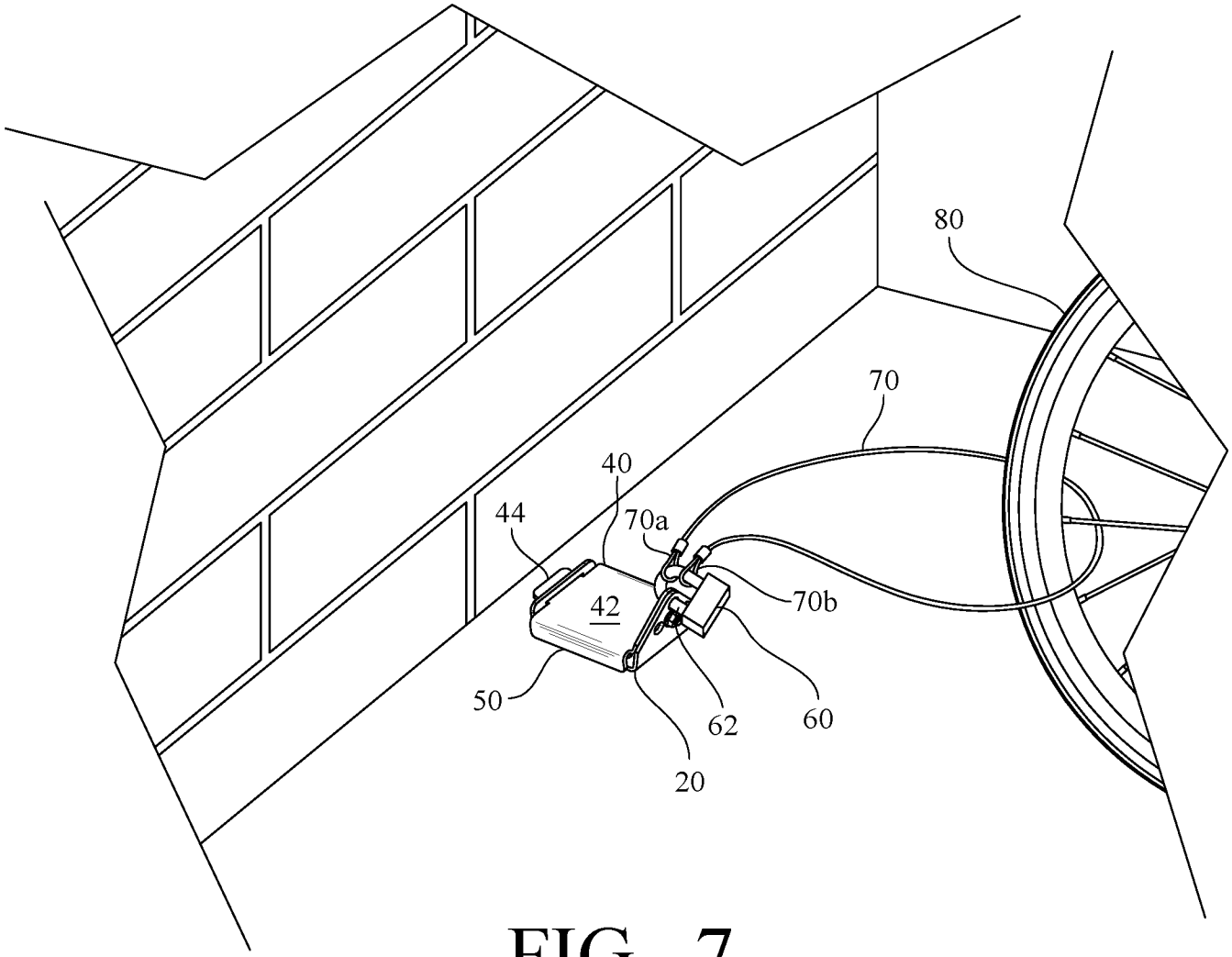
FIG. 7 is similar to FIG. 6, but further illustrates the second plate of the exemplary security anchor of FIG. 1 placed over and into engagement with the first plate, with a shackle of a padlock passing through a selected pair of registered holes of the respective plates and through a locking cable, which, in turn, is looped through a bicycle wheel.

Once the security anchor 10 has been assembled with the second plate 40 placed over and into engagement with the first plate 20, a padlock, chain, cable, or similar locking device is then passed through a selected pair of registered holes 26*a*, 46*a*. That padlock, chain, cable, or similar locking device is then connected to an item that is to be secured. FIG. 7 illustrates the second plate 40 placed over and into engagement with the first plate 20, with a shackle 62 of a padlock 60 passing through a selected pair of registered holes 26*a*, 46*a*. The shackle 62 of the padlock 60 also passes through the two end loops 70*a*, 70*b* of a locking cable 70, which, in turn, is looped through a bicycle wheel 80. Thus, the padlock, chain, cable, or similar locking device not only secures the item (such as a bicycle), but it also effectively locks the first plate 20 of the security anchor 10 to the second plate 40 (which is why the carriage bolt 36 and nut 37 combination is not required during use). In this arrangement, the fasteners 32*a*, 32*b* that secure the security anchor 10 to the fixed object are not accessible, as they are behind the central portion 42 of the second plate 40. Furthermore, the first leg 50 and the second leg 52 that extend downwardly from the central portion 42 of the second plate 40 prevent any access to the fasteners 32*a*, 32*b* from the side. Thus, the security anchor 10 of the present invention cannot be readily removed or dislodged from the fixed object.

One of ordinary skill in the art will recognize that additional embodiments and implementations are also possible without departing from the teachings of the present invention. This detailed description, and particularly the specific details of the exemplary embodiments and implementations disclosed therein, is given primarily for clarity of understanding, and no unnecessary limitations are to be understood therefrom, for modifications will become obvious to those skilled in the art upon reading this disclosure and may be made without departing from the spirit or scope of the invention.

What is claimed is:

1. A security anchor, comprising:

a first plate, including (i) a central portion with one or more holes defined therethrough, with each of the one or more holes adapted to accommodate a fastener, (ii) a first upstanding wall portion along one edge of the central portion and defining a slot therethrough, and (iii) a second upstanding wall portion along an opposite edge of the central portion and defining one or more holes therethrough; and a second plate, including (i) a central portion, (ii) a tab extending from one edge of the central portion, (iii) an upstanding wall portion along an opposite edge of the central portion and defining one or more holes therethrough, (iv) a first leg that extends downwardly from a side edge of the central portion, and (v) a second leg that extends downwardly from an opposite side edge of the central portion;

wherein the second plate is adapted to fit over and engage the first plate, with the tab of the second plate received in the slot defined by the first upstanding wall portion of the first plate, and with the one or more holes defined through the upstanding wall portion of the second plate in registry with the one or more holes defined through the second upstanding wall portion of the first plate, such that, in use, a locking device can be passed through a selected pair of registered holes and connected to an item that is to be secured.

2. The security anchor as recited in claim 1, wherein the second upstanding wall portion of the first plate is oriented at a predetermined angle relative to the central portion of the first plate, and the upstanding wall portion of the second plate is oriented at the predetermined angle relative to the central portion of the second plate.

3. The security anchor as recited in claim 2, wherein the predetermined angle is approximately 105°.

4. A security anchor, comprising:

a first plate, including (i) a central portion with one or more holes defined therethrough, with each of the one or more holes adapted to accommodate a fastener, (ii) a first upstanding wall portion along one edge of the central portion and defining a slot therethrough, and (iii) a second upstanding wall portion along an opposite edge of the central portion and defining one or more holes therethrough; and a second plate, including (i) a central portion, (ii) a tab extending from one edge of the central portion, (iii) an upstanding wall portion along an opposite edge of the central portion and defining one or more holes therethrough, wherein the tab comprises a first segment that is in the same plane as the central portion, and a second segment that extends upward at a predetermined angle relative to the first segment of the tab;

wherein the second plate is adapted to fit over and engage the first plate, with the tab of the second plate received in the slot defined by the first upstanding wall portion of the first plate, and with the one or more holes defined through the upstanding wall portion of the second plate in registry with the one or more holes defined through the second upstanding wall portion of the first plate, such that, in use, a locking device can be passed through a selected pair of registered holes and connected to an item that is to be secured.

5. The security anchor as recited in claim 4, wherein the predetermined angle is approximately 15°.

6. A combination, comprising:

a locking device; and a security anchor, including a first plate, including (i) a central portion with one or more holes defined therethrough, with each of the one or more holes adapted to accommodate a fastener, (ii) a first upstanding wall portion along one edge of the central portion and defining a slot therethrough, and (iii) a second upstanding wall portion along an opposite edge of the central portion and defining one or more holes therethrough, and a second plate, including (i) a central portion, (ii) a tab extending from one edge of the central portion, (iii) an upstanding wall portion along an opposite edge of the central portion and defining one or more holes therethrough, (iv) a first leg that extends downwardly from a side edge of the central portion, and (v) a second leg that extends downwardly from an opposite side edge of the central portion, wherein the second plate is adapted to fit over and engage the first plate, with the tab of the second plate received in the slot defined by the first upstanding wall portion of the first plate, and with the one or more holes defined through the upstanding wall portion of the second plate in registry with the one or more holes defined through the second upstanding wall portion of the first plate, such that, in use, the locking device can be passed through a selected pair of registered holes and connected to an item that is to be secured.

7. The combination as recited in claim 6, wherein the locking device is a padlock.

8. The combination as recited in claim 6, wherein the locking device is a cable.

9. The combination as recited in claim 6, wherein the second upstanding wall portion of the first plate is oriented at a predetermined angle: relative to the central portion of the first plate, and the upstanding wall portion of the second plate is oriented at the predetermined angle relative to the central portion of the second plate.

10. The combination as recited in claim 9, wherein the predetermined angle is approximately 105°.

11. The combination as recited in claim 6, wherein the tab comprises a first segment that is in the same plane as the central portion of the second plate, and a second segment that extends upward at a predetermined angle relative to the first segment of the tab.

12. The combination as recited in claim 11, wherein the predetermined angle is approximately 15°.

13. A combination, comprising:

multiple fasteners;

a locking device; and a security anchor, including a first plate, including (i) a central portion with multiple holes defined therethrough, with each of the multiple holes adapted to accommodate one of the multiple fasteners to secure the first plate to a fixed object, (ii) a first upstanding wall portion along one edge of the central portion and defining a slot therethrough, and (iii) a second upstanding wall portion along an opposite edge of the central portion and defining one or more holes therethrough, and a second plate, including (i) a central portion, (ii) a tab extending from one edge of the central portion, and (iii) an upstanding wall portion along an opposite edge of the central portion and defining one or more holes therethrough, wherein the second plate is adapted to fit over and engage the first plate, with the tab of the second plate received in the slot defined by the first upstanding wall portion of the first plate, and with the one or more holes defined through the upstanding wall portion of the second plate in registry with the one or more holes defined through the second upstanding wall portion of the first plate, such that, in use, the locking device can be passed through a selected pair of registered holes and connected to an item that is to be secured.

14. The combination as recited in claim 13, wherein the second upstanding wall portion of the first plate is oriented at a predetermined angle relative to the central portion of the first plate, and the upstanding wall portion of the second plate is oriented at the predetermined angle relative to the central portion of the second plate.

15. The combination as recited in claim 14, wherein the predetermined angle is approximately 105°.

16. The combination as recited in claim 13, wherein the tab comprises a first segment that is in the same plane as the central portion of the second plate, and a second segment that extends upward at a predetermined angle relative to the first segment of the tab.

17. The combination as recited in claim 16, wherein the predetermined angle is approximately 15°.

18. The combination as recited in claim 13, wherein the locking device is a padlock.

19. The combination as recited in claim 13, wherein the locking device is a cable.

* * * * *